US011800289B2

(12) United States Patent
Yan et al.

(10) Patent No.: US 11,800,289 B2
(45) Date of Patent: Oct. 24, 2023

(54) SOUND GENERATOR

(71) Applicant: AAC Microtech (Changzhou) Co., Ltd., Changzhou (CN)

(72) Inventors: Xudong Yan, Shenzhen (CN); Tao Shao, Shenzhen (CN); Xiaojiang Gu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 56 days.

(21) Appl. No.: 17/535,719

(22) Filed: Nov. 26, 2021

(65) Prior Publication Data

US 2022/0174414 A1 Jun. 2, 2022

(30) Foreign Application Priority Data

Nov. 30, 2020 (CN) ..... 202011384307.8

(51) Int. Cl.
*H04R 9/06* (2006.01)
*H04R 9/02* (2006.01)
*H04R 9/04* (2006.01)

(52) U.S. Cl.
CPC ..... *H04R 9/025* (2013.01); *H04R 9/043* (2013.01); *H04R 9/045* (2013.01); *H04R 9/06* (2013.01);
(Continued)

(58) Field of Classification Search
CPC ..... H04R 1/24; H04R 9/025; H04R 9/043; H04R 9/045; H04R 9/06; H04R 9/063;
(Continued)

(56) References Cited

U.S. PATENT DOCUMENTS 6,744,895 B2 * 6/2004 Miyamoto ..... H04R 9/10 381/342
2002/0051557 A1 * 5/2002 Kobayashi ..... H04R 9/06 381/401

(Continued)

FOREIGN PATENT DOCUMENTS

CN 205283802 U * 6/2016
CN 205283802 U 6/2016
CN 211531288 U 9/2020

OTHER PUBLICATIONS

2nd Office Action dated Nov. 30, 2021 by SIPO in related Chinese Patent Application No. 202011384307.8(11 Pages).

*Primary Examiner* — Huyen D Le
(74) *Attorney, Agent, or Firm* — W&G Law Group

(57) ABSTRACT

Disclosed is a sound generator, including a bracket, and a vibration system and a magnetic circuit system. The vibration system includes a first vibration diaphragm, s a second vibration diaphragm, a first voice coil driving the first vibration diaphragm, and a second voice coil driving the second vibration diaphragm. The magnetic circuit system includes an iron core, a magnet assembly, and a magnetic frame. The first voice coil is disposed between the magnetic frame and the magnet assembly, and the second voice coil is disposed between the magnet assembly and the iron core. Therefore, two magnetic circuit structures are provided in the same magnetic frame space and drive the first vibration diaphragm and the second vibration diaphragm to vibrate and generate sound in different directions respectively, which improves the utilization efficiency of the magnetic circuit system while saving space, thereby improving the sound generation performance of the sound generator.

9 Claims, 8 Drawing Sheets

(52) U.S. Cl.
CPC ..... *H04R 9/063* (2013.01); *H04R 2209/026* (2013.01); *H04R 2400/11* (2013.01)

(58) Field of Classification Search
CPC ..... H04R 2209/026; H04R 2209/041; H04R 2400/11
See application file for complete search history.

(56) References Cited

U.S. PATENT DOCUMENTS

| | | | | |
|---|---|---|---|---|
| 2007/0297635 | A1* | 12/2007 | Kano | H04R 9/045 381/394 |
| 2010/0278370 | A1* | 11/2010 | Chang | H04R 9/025 381/396 |
| 2015/0271605 | A1* | 9/2015 | Zhang | H04R 9/025 381/401 |
| 2021/0352410 | A1* | 11/2021 | O'Brien | H04R 9/022 |
| 2022/0279280 | A1* | 9/2022 | Liu | H04R 9/06 |

* cited by examiner

SOUND GENERATOR

TECHNICAL FIELD

The present invention relates to the field of sound-to-electric conversion, and in particular to a sound generator.

BACKGROUND ART

A sound generator in the related art comprises a magnetic circuit system, a voice coil, and a bracket for bearing the magnetic circuit system and the voice coil. When an electrical signal flows through the voice coil, the powered voice coil is subjected to an ampere force in a magnetic field generated by the magnetic circuit system, thus causing the voice coil to vibrate, and the vibration of the voice coil drives a diaphragm to vibrate. This vibration converts mechanical energy into sound energy signals, which are radiated out and propagated to human ears through the air medium. Generally, we can hear relevant sound information.

Currently, the magnetic circuit system is of a low utilization efficiency, thereby affecting the sound generation performance of the sound generator.

Therefore, there is a need to provide an improved sound generator to solve the above problems.

SUMMARY OF THE INVENTION

The object of the present invention is to provide a sound generator, which may improve the use efficiency of a magnetic circuit system by improving the design of the magnetic circuit system, thereby improving the sound generation performance of the sound generator.

The technical solution of the present invention is as follows: a sound generator, comprising a bracket, and a vibration system and a magnetic system that are fixedly connected to the bracket, wherein the vibration system comprises a first vibration diaphragm, a second vibration diaphragm disposed opposite to the first vibration diaphragm, a first voice coil driving the first vibration diaphragm, and a second voice coil driving the second vibration diaphragm, wherein the magnetic circuit system comprises an iron core, a magnet assembly sleeved on the iron core, and a magnetic frame sleeved on the magnet assembly, the first voice coil is disposed between the magnetic frame and the magnet assembly, and the second voice coil is disposed between the magnet assembly and the iron core.

Optionally, the vibration system further comprises a first voice coil bobbin disposed between the magnetic frame and the magnet assembly and a second voice coil bobbin disposed between the magnet assembly and the iron core, wherein one end of the first voice coil bobbin facing the first vibration diaphragm is connected to the first vibration diaphragm, the other end of the first voice coil bobbin away from the first vibration diaphragm is connected to the first voice coil, and the first voice coil is disposed on the first voice coil bobbin in a wound manner; and one end of the second voice coil bobbin facing the second vibration diaphragm is connected to the second vibration diaphragm, the other end of the second voice coil bobbin away from the second vibration diaphragm is connected to the second voice coil, and the second voice coil is disposed on the second voice coil bobbin in a wound manner.

Optionally, the magnetic frame comprises a bottom portion bearing the magnet assembly and a first side wall disposed around the bottom portion, the first side wall and the bottom portion form an accommodating cavity for accommodating the magnet assembly and the iron core, the bottom portion is provided with an opening, and the second voice coil bobbin penetrates through the opening and is disposed between the magnet assembly and the iron core.

Optionally, the iron core comprises a base and a column body located in a central area of the base, the magnet assembly is sleeved on the column body, and the base of the iron core cooperates with the bottom portion of the magnetic frame to limit the magnet assembly.

Optionally, the magnet assembly comprises a first magnet, a second magnet, and a pole core for spacing the first magnet and the second magnet, wherein the first magnet, the pole core and the second magnet are disposed in the vibration direction of the first vibration diaphragm.

Optionally, the first vibration diaphragm comprises a first dome and a first sound membrane connected to the outer periphery of the first dome, an outer edge of the first sound membrane is fixed to the bracket, and the first dome is connected to the first voice coil bobbin; and the second vibration diaphragm comprises a second dome and a second sound membrane connected to the outer periphery of the second dome, an outer edge of the second sound membrane is fixed to the bracket, and the second dome is connected to the second voice coil bobbin.

Optionally, the bracket comprises a bearing portion for bearing the magnetic frame, the bearing portion comprises a second side wall disposed around the magnetic frame, and the second side wall limits the magnetic frame.

Optionally, the magnetic frame comprises a first end portion facing the first vibration diaphragm and a lug extending from the first end portion in a direction away from the iron core, and the lug is connected to the bearing portion.

Optionally, the vibration system further comprises a damper disposed between the first vibration diaphragm and the second vibration diaphragm, the bracket further comprises a body and a connection skeleton protruding from the body toward the bearing portion, the connection skeleton connects the body and the bearing portion, and the damper is mounted on the connection skeleton.

Optionally, the vibration system further comprises a first connection piece connected to the first vibration diaphragm and a second connection piece connected to the second vibration diaphragm, and the damper comprises a first sub-portion and a second sub-portion that are connected to each other, wherein the first connection piece comprises a first annular portion connected to the first vibration diaphragm and a first extension portion extending from the first annular portion toward the damper, and the first extension portion is connected to the first sub-portion; and the second connection piece comprises a second annular portion connected to the second vibration diaphragm and a second extension portion extending from the second annular portion toward the damper, and the second extension portion is connected to the second sub-portion.

The beneficial effects of the present invention are in that a magnetic circuit system comprises an iron core, a magnet assembly sleeved on the iron core, and a magnetic frame sleeved on the magnet assembly, the first voice coil is disposed between the magnetic frame and the magnet assembly, and the second voice coil is disposed between the magnet assembly and the iron core. The magnetic circuit system composed of the magnetic frame and the magnet assembly provides a driving force for the first voice coil, thereby driving the first vibration diaphragm to vibrate and generate sound, and the magnetic circuit system composed of the magnet assembly and the iron core provides a driving force for the second voice coil, thereby driving the second vibration diaphragm to vibrate and generate sound. Therefore, two magnetic circuit structures are provided in the same magnetic frame space and drive the first vibration diaphragm and the second vibration diaphragm to vibrate and generate sound in different directions respectively, which improves the utilization efficiency of the magnetic circuit system while saving space, thereby improving the sound generation performance of the sound generator.

DETAILED DESCRIPTION OF EMBODIMENTS

The present invention will be further described in conjunction with the accompanying drawings and embodiments below.

Figure 1:
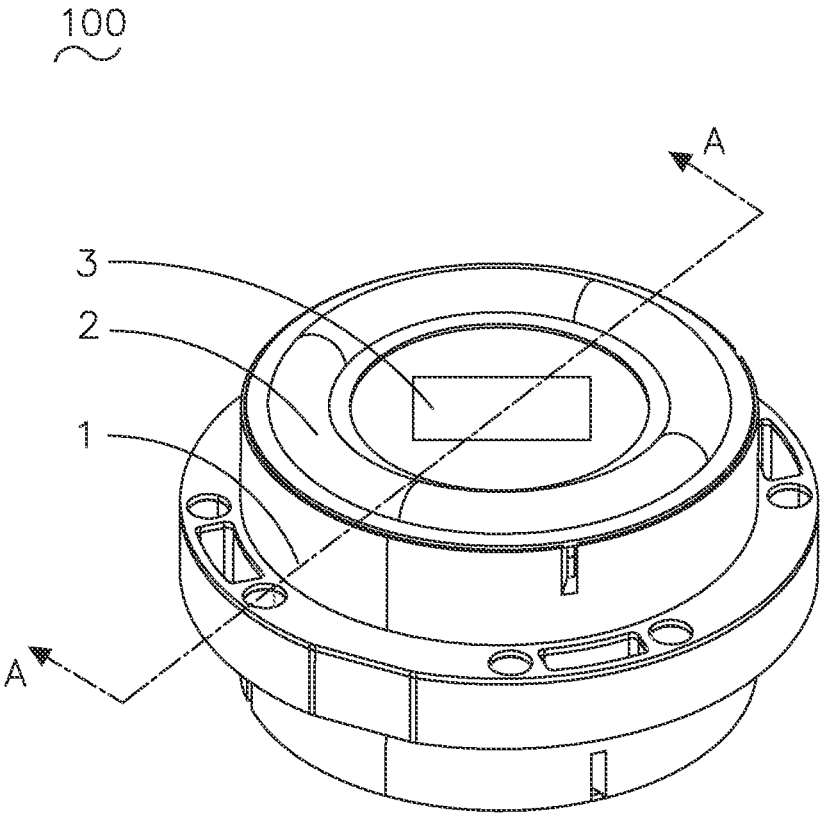
FIG. 1 is a schematic structural diagram of a sound generator provided in an embodiment of the present invention.
Figure 2:
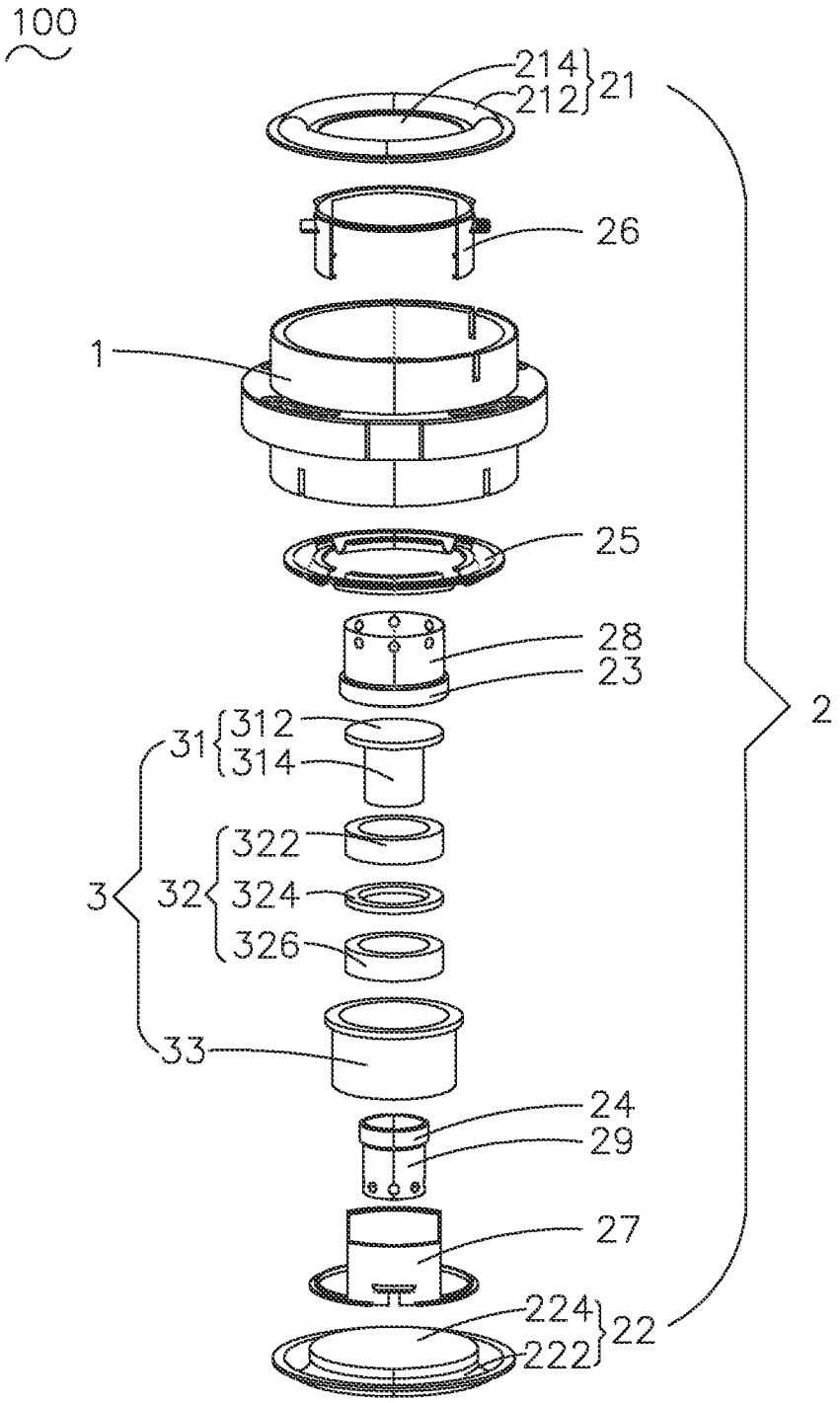
FIG. 2 is an exploded schematic structural diagram of the sound generator shown in FIG. 1.
Figure 3:
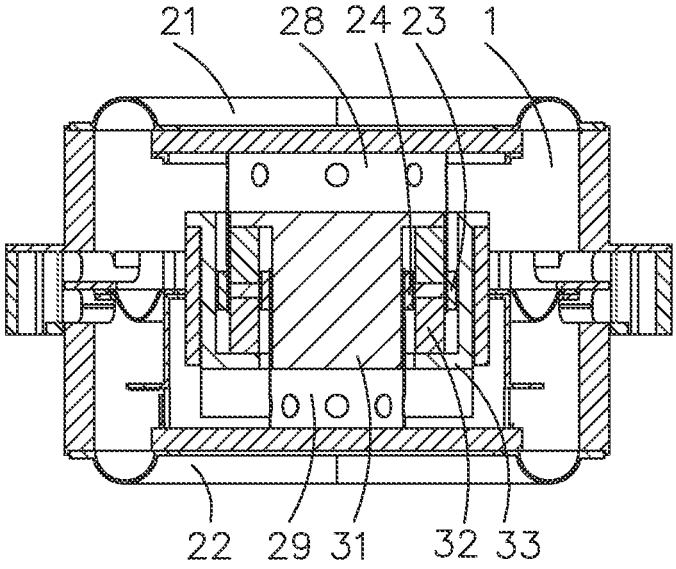
FIG. 3 is a sectional view of the sound generator shown in FIG. 1 along the direction A-A.

Referring to FIGS. 1-3, FIG. 1 is a schematic structural diagram of a sound generator provided in an embodiment of the present invention; FIG. 2 is an exploded schematic structural diagram of the sound generator shown in FIG. 1; and FIG. 3 is a sectional view of the sound generator shown in FIG. 1 along the direction A-A. The present invention provides a sound generator 100, which comprises a bracket 1, and a vibration system 2 and a magnetic circuit system 3 that are fixedly connected to the bracket 1. The bracket 1 may provide support for the vibration system 2 and the magnetic circuit system 3, and the magnetic circuit system 3 may drive the vibration system 2 to vibrate and generate sound.

The vibration system 2 comprises a first vibration diaphragm 21, a second vibration diaphragm 22 disposed opposite to the first vibration diaphragm 21, a first voice coil 23 driving the first vibration diaphragm 21, and a second voice coil 24 driving the second vibration diaphragm 22.

The vibration system 2 further comprises a first voice coil bobbin 28 disposed between a magnetic frame 33 and a magnet assembly 32 and a second voice coil bobbin 29 disposed between the magnet assembly 32 and an iron core 31. The first voice coil bobbin 28 and the second voice coil bobbin 29 are both annular. One end of the first voice coil bobbin 28 facing the first vibration diaphragm 21 is connected to the first vibration diaphragm 21, the other end of the first voice coil bobbin 28 away from the first vibration diaphragm 21 is connected to the first voice coil 23, and the first voice coil 23 is disposed on the first voice coil bobbin 28 in a wound manner, such that the first voice coil 23 vibrates through the first voice coil bobbin 28 to drive the first vibration diaphragm 21 to vibrate, thereby producing sound in a first sound generation direction. One end of the second voice coil bobbin 29 facing the second vibration diaphragm 22 is connected to the second vibration diaphragm 22, the other end of the second voice coil bobbin 29 away from the second vibration diaphragm 22 is connected to the second voice coil 24, and the second voice coil 24 is disposed on the second voice coil bobbin 29 in a wound manner, such that the second voice coil 24 vibrates through the second voice coil bobbin 29 to drive the second vibration diaphragm 22 to vibrate, thereby producing sound in a second sound generation direction. The second sound generation direction and the first sound generation direction are different and opposite directions.

The first vibration diaphragm 21 comprises a first dome 214 and a first sound membrane 212 connected to the outer periphery of the first dome 214. The first dome 214 may be annular, and the first sound membrane 212 has an outer edge, an inner edge, and a recess disposed between the outer edge and the inner edge. The first sound membrane 212 further comprises a first circular cavity formed by the inner edge. The first dome 214 is clamped at the inner edge of the first sound membrane 212 to form a first sound generation side structure that is enclosed. The outer edge of the first sound membrane 212 is fixed to the bracket 1, and the first dome 214 is connected to the first voice coil bobbin 28, such that the first dome 214 and the first sound membrane 212 vibrate and generate sound under driving of the first voice coil bobbin 28.

The second vibration diaphragm 22 comprises a second dome 224 and a second sound membrane 222 connected to the outer periphery of the second dome 224. The second dome 224 may be annular, and the second sound membrane 222 has an outer edge, an inner edge, and a recess disposed between the outer edge and the inner edge. The second sound membrane 222 further comprises a second circular cavity formed by the inner edge. The second dome 224 is clamped at the inner edge of the second sound membrane 222 to form a second sound generation side structure that is enclosed. The outer edge of the second sound membrane 222 is fixed to the bracket 1, and the second dome 224 is connected to the second voice coil bobbin 29, such that the second dome 224 and the second sound membrane 222 vibrate and generate sound under driving of the second voice coil bobbin 29.

For ease of manufacturing, the second dome 224 and the first dome 214 may be configured to have structures of the same shape and size, or the second sound membrane 222 and the first sound membrane 212 may be configured to have structures of the same shape and size.

The magnetic circuit system 3 comprises an iron core 31, a magnet assembly 32 sleeved on the iron core 31, and a magnetic frame 33 sleeved on the magnet assembly 32. The first voice coil 23 is disposed between the magnetic frame 33 and the magnet assembly 32. Exemplarily, the first voice coil 23 and the second voice coil 24 may have a hollow columnar shape, the first voice coil 23 is inserted in a gap between the magnetic frame 33 and the magnet assembly 32, and the second voice coil 24 is inserted in a gap between the magnet assembly 32 and the iron core 31. The magnetic frame 33 and the magnet assembly 32 drive the first voice coil 23 and the first vibration diaphragm 21 to vibrate, so as to generate sound from the first vibration diaphragm 21 in a direction away from the first voice coil 23. The second voice coil 24 is disposed between the magnet assembly 32 and the iron core 31, and the magnet assembly 32 and the iron core 31 drive the second voice coil 24 and the second vibration diaphragm 22 to vibrate, so as to generate sound in a direction away from the second voice coil 24 from the second vibration diaphragm 22. By nesting the iron core 31, the magnet assembly 32, and the magnetic frame 33, space can be saved. Two sets of magnetic circuit systems are provided within a limited size range for the magnetic frame to increase the use efficiency of a magnetic circuit.

The magnet assembly 32 comprises a first magnet 322, a second magnet 324, and a pole core 326 for spacing the first magnet 322 from the second magnet 324. The first magnet 322, the pole core 326, and the second magnet 324 are disposed in a vibration direction of the first vibration diaphragm 21 to separate a first magnetic circuit system composed of the first magnet 322 and the magnetic frame 33 from a second magnetic circuit system composed of the second magnet 324 and the iron core 31, so that there is no mutual interference. The pole core 326 may be annular and is sleeved on the second voice coil 24, and the first voice coil 23 is sleeved on the pole core 326. The first voice coil 23, the pole core 326, and the second voice coil 24 are nested with each other.

In some embodiments, the first magnet 322 may be annular, and the thickness of the first magnet 322 is greater than that of the pole core 326. For ease of manufacturing, the second magnet 324 may also be annular, and the thickness of the first magnet 322 and the second magnet 324 may be the same or different, so that the first magnet 322 interacts with the magnetic frame 33 to generate the first magnetic circuit system, and the second magnet 324 interacts with the iron core 31 to generate the second magnetic circuit system. The first magnet 322 and the second magnet 324 are symmetrically disposed with respect to the pole core 326, so as to save space.

Figure 8:
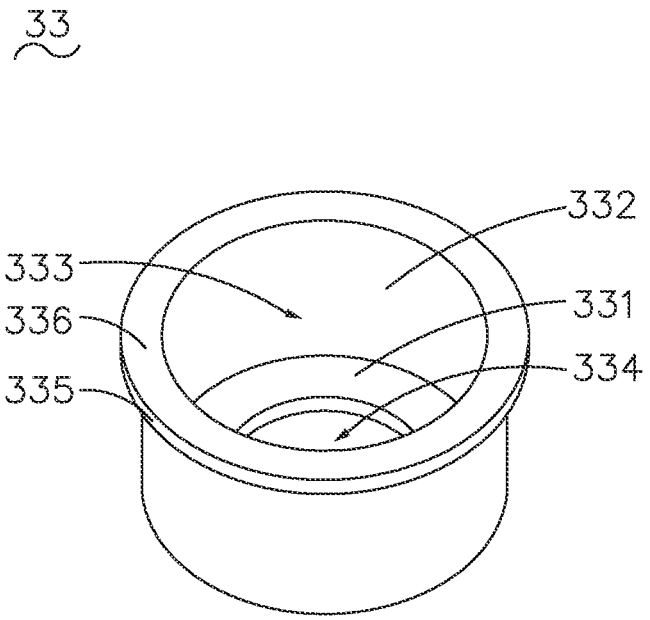
FIG. 8 is a schematic structural diagram of a magnetic frame in the sound generator shown in FIG. 2.

Referring to FIG. 8, it is a schematic structural diagram of the magnetic frame in the sound generator shown in FIG. 2. The magnetic frame 33 may comprise a bottom portion 331 that bears the magnet assembly and a first side wall 332 disposed around the bottom portion. The first side wall 332 and the bottom portion form a magnetic frame accommodating cavity 333 for accommodating the magnet assembly and the iron core. For example, the magnetic frame 33 may be annular. The bottom portion of the magnetic frame 33 is provided with an opening 334. The opening 334 may be circular. The second voice coil bobbin 29 penetrates through the circular opening and is disposed between the magnet assembly 32 and the iron core 31. The bottom portion 331 of the magnetic frame 33 may bear the magnet assembly 32, and no other structure is needed to bear the magnet assembly, which reduces the number of structural members.

The magnetic frame 33 further comprises a first end portion 336 facing the first vibration diaphragm 21 and a lug 335 extending from the first end portion 336 in a direction away from the iron core 31. The lug 335 may be annular and is connected to the bracket 1. The magnetic frame 33 is disposed on the bracket 1 by means of the lug 335, and the lug 335 may be fixedly connected to the bracket 1 by means of glue, interlocking, etc., such that the magnetic frame 33 can be fixed into the bracket 1 conveniently.

The iron core 31 comprises a base 312 and a column body 314 located in a central area of the base. The base 312 and the column body 314 are both annular, and the thickness of the column body 314 is greater than that of the base. In some embodiments, the thickness of the column body 314 is equal to the thickness of the magnet assembly plus the thickness of the opening at the bottom portion of the magnetic frame. The magnet assembly 32 is sleeved on the column body 314, and the base 312 of the iron core 31 cooperates with the bottom portion 331 of the magnetic frame 33 to limit the magnet assembly 32. The base 312 of the iron core and the bottom portion 331 of the magnetic frame are used to abut against the magnet assembly from both sides, and therefore, the magnet assembly may be well limited without other structures.

The magnetic frame 33 and the magnet assembly 32 form the first magnetic circuit system, which drives the first voice coil 23 to reciprocate, thereby driving the first dome 214 and the first sound membrane 212 to vibrate and generate sound in the first sound generation direction.

The magnet assembly 32 and the iron core 31 form the second magnetic circuit system, which drives the second voice coil 24 to reciprocate, thereby driving the second dome 224 and the second sound membrane 222 to vibrate and generate sound in the second sound generation direction.

Figure 4:
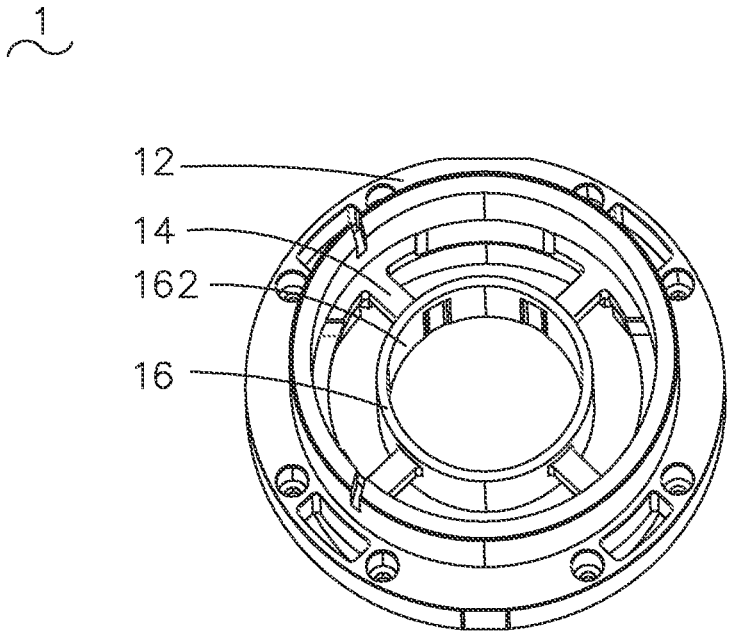
FIG. 4 is a schematic structural diagram of a bracket in the sound generator shown in FIG. 1.

Referring to FIG. 4, it is a schematic structural diagram of the bracket in the sound generator shown in FIG. 1. The bracket 1 comprises a bearing portion 16 for bearing the magnetic frame 33. The bearing portion 16 may be annular and comprise a second side wall 162 disposed around the magnetic frame 33. The second side wall 162 is used to limit the motion of the magnetic frame 33 in a peripheral direction. The length of the second side wall 162 in the vibration direction of the first vibration diaphragm 21 may be equal to or close to that of the magnetic frame 33 in the vibration direction of the first vibration diaphragm 21, so as to well limit the magnetic frame and prevent the magnetic frame 33 from shaking.

One end of the bearing portion 16 facing the first vibration diaphragm 21 may be connected to the lug 335 of the magnetic frame, for bearing the magnetic frame 33.

Still referring FIG. 4, the bracket 1 further comprises a body 12 and connection skeletons 14 that are disposed at intervals and protrude from the body 12 toward the bearing portion 16. The connection skeletons 14 connect the body 12 and the bearing portion 16. The bracket 1 may be annular, so as to accommodate the bearing portion 16, the connection skeletons 14, and the magnetic circuit system 3. The connection skeletons 14 may be a plurality of connection plates disposed at intervals, and spaced cavities are used to place related structures.

The bracket 1 further comprises a fixing portion disposed around the bracket body. The fixing portion is annular and provided with a plurality of connection holes, for fixing the bracket 1 to required components. The fixing portion and the bracket body 12 may be integrally formed, or the bracket body 12 may be provided with a plurality of connection holes which are the same as those of the fixing portion, for detachably connecting the bracket body and the fixing portion.

Figure 5:
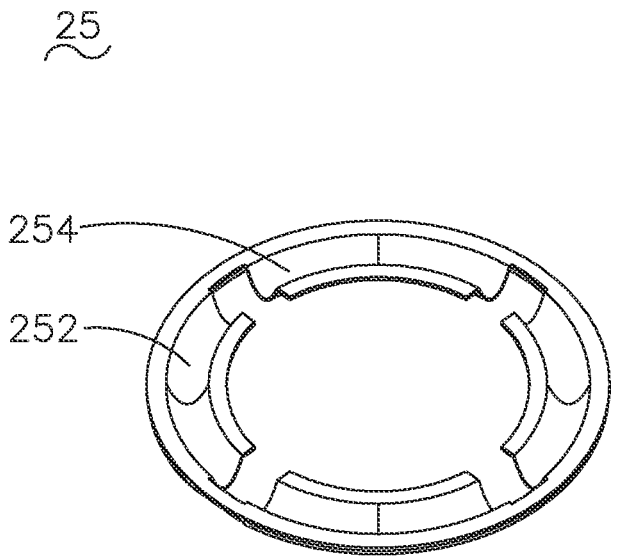
FIG. 5 is a schematic structural diagram of a damper in the sound generator shown in FIG. 2.
Figure 6:
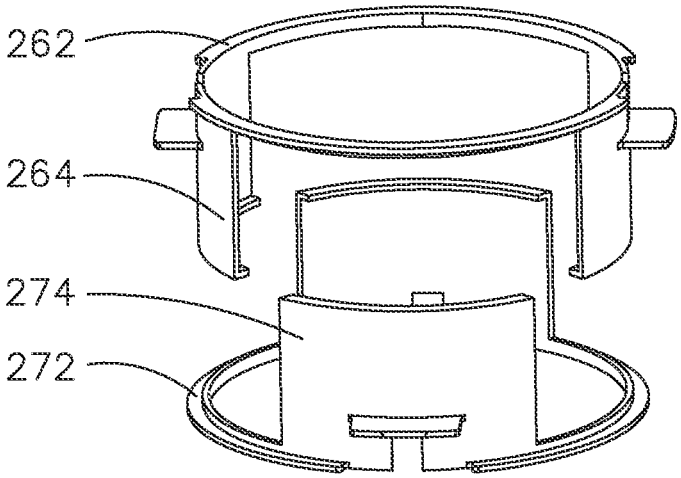
FIG. 6 is a schematic structural diagram of a first connection piece and a second connection piece in the sound generator shown in FIG. 2.
Figure 7:
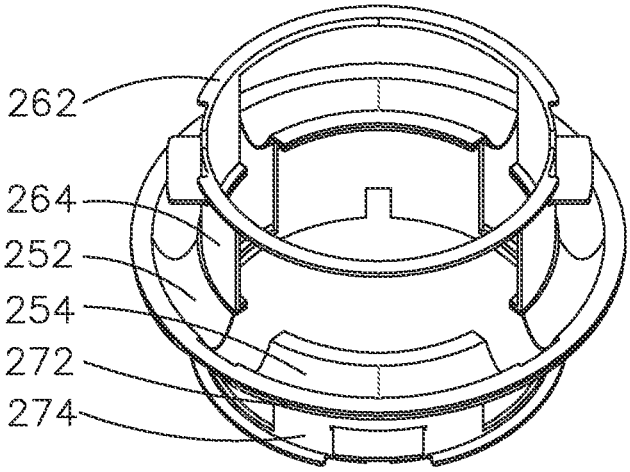
FIG. 7 is a schematic structural diagram of the first connection piece, the damper, and the second connection piece in the sound generator shown in FIG. 2.

Referring to FIGS. 5-7, FIG. 5 is a schematic structural diagram of a damper in the sound generator shown in FIG. 2; FIG. 6 is a schematic structural diagram of a first connection piece and a second connection piece in the sound generator shown in FIG. 2; and FIG. 7 is a schematic structural diagram of the first connection piece, the damper, and the second connection piece in the sound generator shown in FIG. 2.

The vibration system 2 may further comprise an damper 25 disposed between the first vibration diaphragm 21 and the second vibration diaphragm 22, and the damper 25 is mounted on the connection skeleton 14. The shape of the damper 25 may be similar to that of the first sound membrane 212, and the damper may comprise a first sub-portion 252 and a second sub-portion 254. The first sub-portion 252 may be formed by two recesses disposed oppositely, or may be formed by two recesses disposed adjacently. Correspondingly, the second sub-portion 254 may also be formed by two recesses disposed oppositely or adjacently. The four recesses may be connected by means of two annular structures to form an integral unit and may be integrally formed during manufacturing.

Still referring to FIGS. 5-7, the vibration system 2 further comprises a first connection piece 26 connected to the first vibration diaphragm 21 and a second connection piece 27 connected to the second vibration diaphragm 22. The first connection piece 26 comprises a first annular portion 262 connected to the first vibration diaphragm 21 and a first extension portion 264 extending from the first annular portion 262 toward the damper 25. The first extension portion 264 may also comprise two tabs disposed oppositely or adjacently. The first extension portion 264 is connected to the first sub-portion 252. Specifically, the two tabs of the first extension portion 264 are stably connected to edges of the two recesses of the first sub-portion 252 respectively. The second connection piece 27 comprises a second annular portion 272 connected to the second vibration diaphragm 22 and a second extension portion 274 extending from the second annular portion 272 toward the damper. The second extension portion 274 may also comprise two tabs disposed oppositely or adjacently. The second extension portion 274 is connected to the second sub-portion 254. Specifically, the two tabs of the second extension portion 274 are stably connected to edges of the two recesses of the second sub-portion 254 respectively. The damper is connected to the first vibration diaphragm by means of the first connection piece and connected to the second vibration diaphragm by means of the second connection piece respectively, such that vibrations of the first vibration diaphragm and the second vibration diaphragm can be balanced, so as to stabilize sound generation.

Compared with the related art, by arrangement, the magnetic circuit system comprises an iron core, a magnet assembly sleeved on the iron core, and a magnetic frame sleeved on the magnet assembly, the first voice coil is disposed between the magnetic frame and the magnet assembly, and the second voice coil is disposed between the magnet assembly and the iron core. The magnetic circuit system composed of the magnetic frame and the magnet assembly provides a driving force for the first voice coil, thereby driving the first vibration diaphragm to vibrate and generate sound, and the magnetic circuit system composed of the magnet assembly and the iron core provides a driving force for the second voice coil, thereby driving the second vibration diaphragm to vibrate and generate sound. Therefore, two magnetic circuit structures are provided in the same magnetic frame space and drive the first vibration diaphragm and the second vibration diaphragm to vibrate and generate sound in different directions respectively, which improves the utilization efficiency of the magnetic circuit system while saving space, thereby improving the sound generation performance of the sound generator.

In addition, by disposing the magnet assembly between the magnetic frame and the iron core in a top-to-top manner, the abutting limit of the magnet assembly can be realized without extra components, such that the magnet assembly is mounted securely and the magnetic circuit system has a simple structure.

The foregoing descriptions are merely embodiments of the present invention. It should be noted here that for those of ordinary skills in the art, improvements can be made without departing from the inventive concept of the present invention, and these improvements should all fall within the protection scope of the present invention.

What is claimed is:

1. A sound generator, comprising:

a bracket, and a vibration system and a magnetic system that are fixedly connected to the bracket, wherein the vibration system comprises a first vibration diaphragm, a second vibration diaphragm disposed opposite to the first vibration diaphragm, a first voice coil driving the first vibration diaphragm, and a second voice coil driving the second vibration diaphragm, wherein the magnetic circuit system comprises:

an iron core, a magnet assembly sleeved on the iron core, and a magnetic frame sleeved on the magnet assembly, wherein the first voice coil is disposed between the magnetic frame and the magnet assembly, and the second voice coil is disposed between the magnet assembly and the iron core, wherein the magnet assembly comprises a first magnet, a second magnet, and a pole core for spacing the first magnet from the second magnet, wherein the first magnet, the pole core, and the second magnet are disposed in a vibration direction of the first vibration diaphragm.

2. The sound generator as described in claim 1, wherein the vibration system further comprises a first voice coil bobbin disposed between the magnetic frame and the magnet assembly and a second voice coil bobbin disposed between the magnet assembly and the iron core, wherein one end of the first voice coil bobbin facing the first vibration diaphragm is connected to the first vibration diaphragm, the other end of the first voice coil bobbin away from the first vibration diaphragm is connected to the first voice coil, and the first voice coil is disposed on the first voice coil bobbin in a wound manner; and one end of the second voice coil bobbin facing the second vibration diaphragm is connected to the second vibration diaphragm, the other end of the second voice coil bobbin away from the second vibration diaphragm is connected to the second voice coil, and the second voice coil is disposed on the second voice coil bobbin in a wound manner.

3. The sound generator as described in claim 2, wherein the magnetic frame comprises a bottom portion bearing the magnet assembly and a first side wall disposed around the bottom portion, the first side wall and the bottom portion form an accommodating cavity for accommodating the magnet assembly and the iron core, the bottom portion is provided with an opening, and the second voice coil bobbin penetrates through the opening and is disposed between the magnet assembly and the iron core.

4. The sound generator as described in claim 3, wherein the iron core comprises a base and a column body located in a central area of the base, the magnet assembly is sleeved on the column body, and the base of the iron core cooperates with the bottom portion of the magnetic frame to limit the magnet assembly.

5. The sound generator as described in claim 1, wherein the first vibration diaphragm comprises a first dome and a first sound membrane connected to the outer periphery of the first dome, an outer edge of the first sound membrane is fixed to the bracket, and the first dome is connected to the first voice coil bobbin; and the second vibration diaphragm comprises a second dome and a second sound membrane connected to the outer periphery of the second dome, an outer edge of the second sound membrane is fixed to the bracket, and the second dome is connected to the second voice coil bobbin.

6. The sound generator as described in claim 1, wherein the bracket comprises a bearing portion for bearing the magnetic frame, the bearing portion comprises a second side wall disposed around the magnetic frame, and the second side wall limits the magnetic frame.

7. The sound generator as described in claim 6, wherein the magnetic frame comprises a first end portion facing the first vibration diaphragm and a lug extending from the first end portion in a direction away from the iron core, and the lug is connected to the bearing portion.

8. The sound generator as described in claim 6, wherein the vibration system further comprises a damper disposed between the first vibration diaphragm and the second vibration diaphragm, the bracket further comprises a body and a connection skeleton protruding from the body toward the bearing portion, the connection skeleton connects the body and the bearing portion, and the damper is mounted on the connection skeleton.

9. The sound generator as described in claim 8, wherein the vibration system further comprises a first connection piece connected to the first vibration diaphragm and a second connection piece connected to the second vibration diaphragm, and the damper comprises a first sub-portion and a second sub-portion that are connected to each other, wherein the first connection piece comprises a first annular portion connected to the first vibration diaphragm and a first extension portion extending from the first annular portion toward the damper, and the first extension portion is connected to the first sub-portion; and the second connection piece comprises a second annular portion connected to the second vibration diaphragm and a second extension portion extending from the second annular portion toward the damper, and the second extension portion is connected to the second sub-portion.

* * * * *